US006244195B1

(12) United States Patent
Yang

(10) Patent No.: US 6,244,195 B1
(45) Date of Patent: Jun. 12, 2001

(54) SAFETY INCINERATOR FOR RUBBISH IN VOLUME AND FLAMMABLE WASTE

(76) Inventor: Dae Youn Yang, 103-106 Banchun Hyundae Apt. 1023-51, Banchunri, Unyang-un, Ulju-gun, Ulsan (KR)

( * ) Notice: Subject to any disclaimer, the term of this patent is extended or adjusted under 35 U.S.C. 154(b) by 0 days.

(21) Appl. No.: 09/576,209

(22) Filed: May 23, 2000

(51) Int. Cl.[7] ..... F23B 5/04; F23B 1/12

(52) U.S. Cl. ..... 110/248; 110/208; 110/235; 110/248; 110/295; 110/336; 110/173 R

(58) Field of Search ..... 110/308, 208, 110/203, 209, 210, 211, 235, 248, 295, 305, 301, 302, 314, 336, 337, 346, 173 R, 116

(56) References Cited

U.S. PATENT DOCUMENTS

| | | | | |
|---|---|---|---|---|
| 1,790,110 | * | 1/1931 | Nygaard et al. | 110/314 |
| 1,868,329 | * | 7/1932 | Luloffs | 110/314 |
| 4,280,417 | * | 7/1981 | Alexandersson | 110/346 |
| 4,626,258 | * | 12/1986 | Koppleman | 44/2 |
| 4,875,420 | * | 10/1989 | Hay et al. | 110/215 |
| 5,158,043 | * | 10/1992 | Emsbo | 122/498 |
| 5,245,983 | * | 9/1993 | Krieger | 126/163 R |
| 5,913,274 | * | 6/1999 | Kunzil et al. | 110/328 |
| 5,957,064 | * | 10/1999 | Barry et al. | 110/188 |

FOREIGN PATENT DOCUMENTS

458032 * 3/1928 (DE) .

* cited by examiner

*Primary Examiner*—Denise L. Ferensic
*Assistant Examiner*—K. B. Rinehart
(74) *Attorney, Agent, or Firm*—Jacobson, Price, Holman & Stern, PLLC

(57) ABSTRACT

This invention is a mass incinerator for burning various rubbishes (life rubbishes, industry wastes, hospital rubbishes and like) and flammable wastes (hospital wastes, poison material and like) under high temperature atmosphere. In particularly; to an incinerator in which the combustion chambers 101 constructed in a dome form and the auxiliar combustion chambers 102 are connected alternately to form a tunnel shape. An air supply chamber 104 is formed between the outside wall and the inside wall of the combustion chamber 101. The materials being burned are inputted through the double hinged gate so that the soot or the dust is not scattered outward. The input during the combustion process is possible to improve the treating whereby rubbishes or wastes are completely burnt to prevent the environmental pollutant such as heavy metal material or dioxin as well as soot from discharging. Also, the hot water produced by the heat generated from the combustion process is supplied for agriculture, industry and home and used for generating electricity.

1 Claim, 4 Drawing Sheets

【FIG 1】
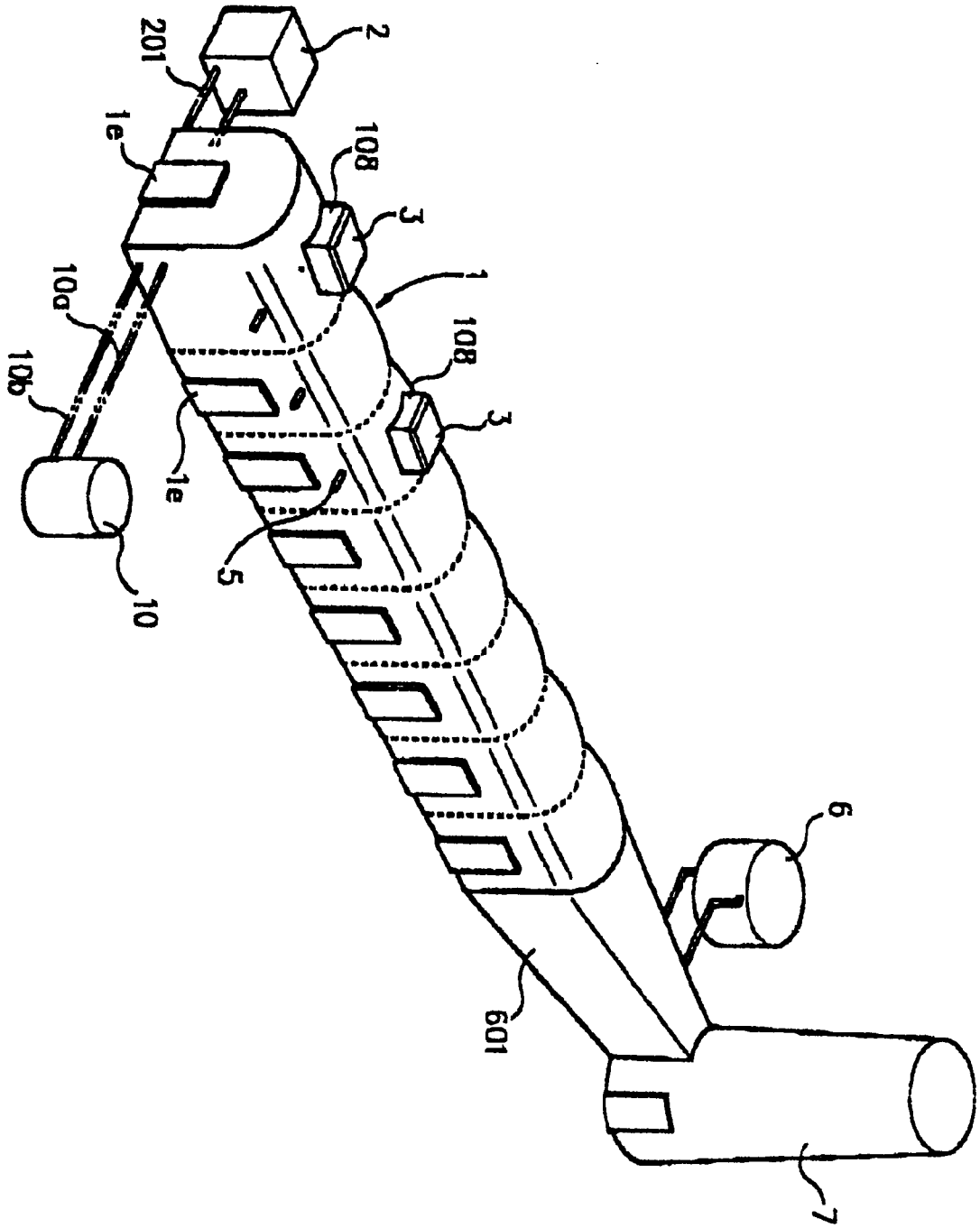

【FIG 2】
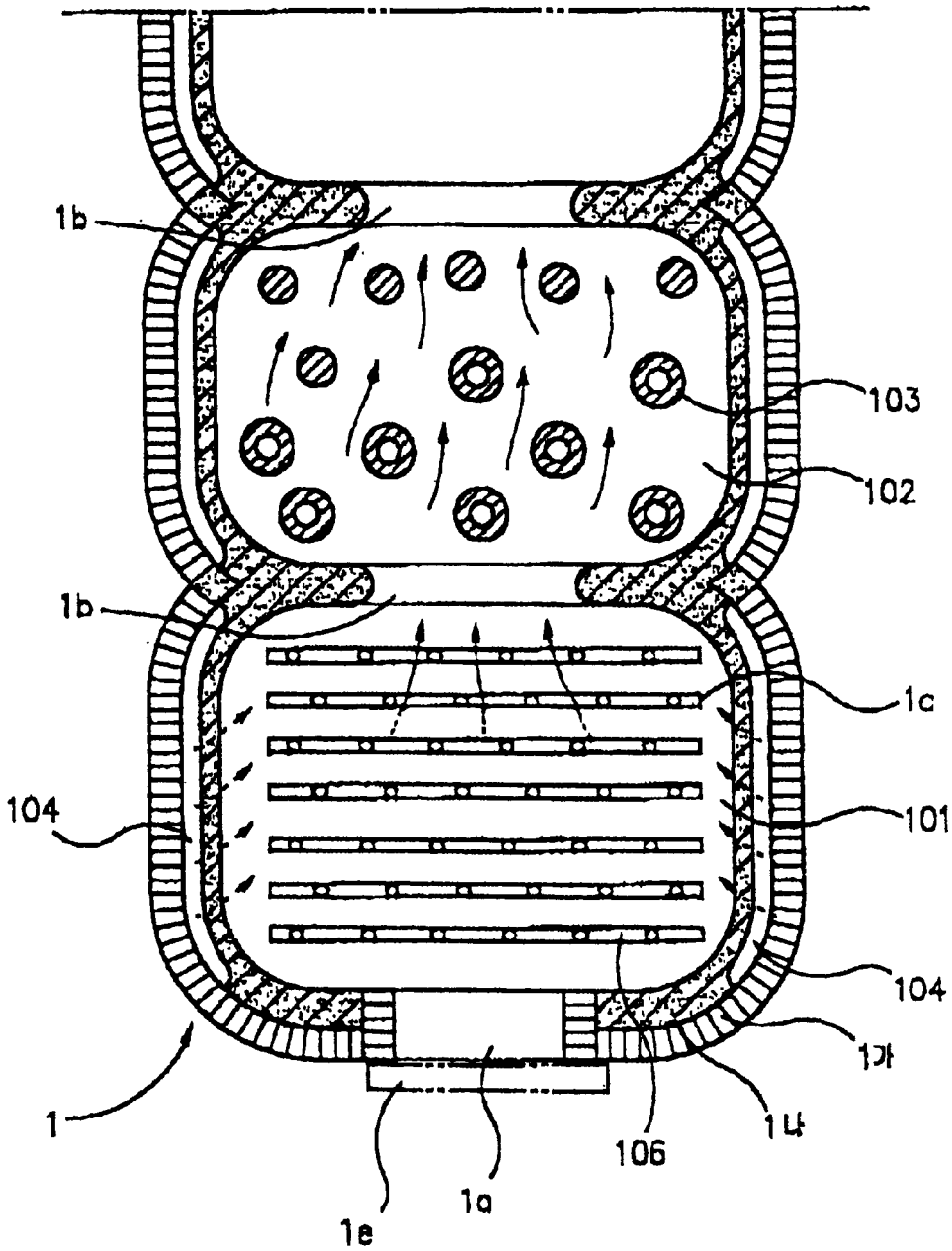

【FIG 3】
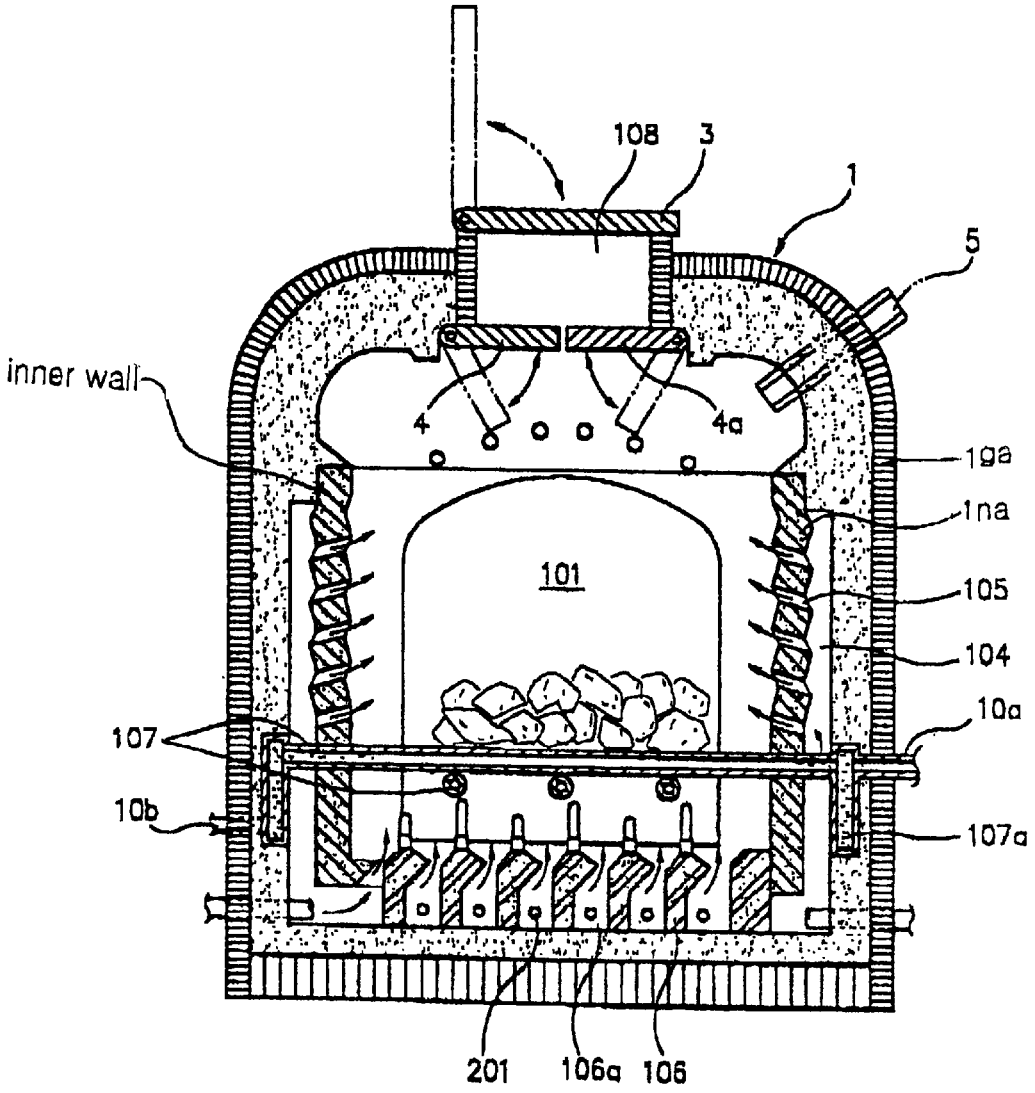

【FIG 4】
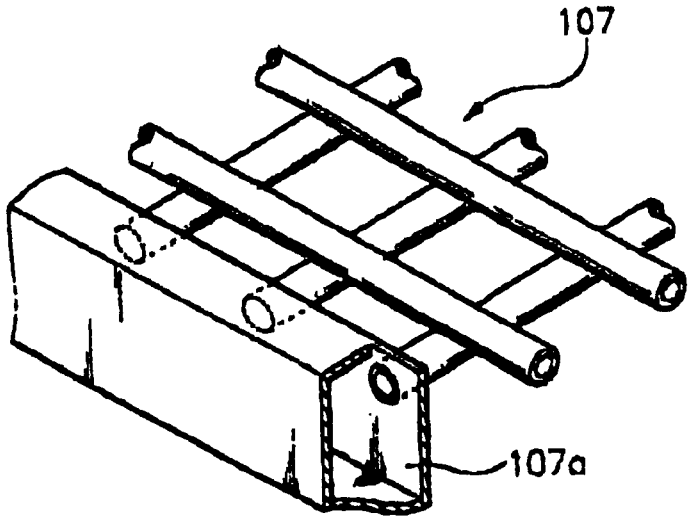
【FIG 5】
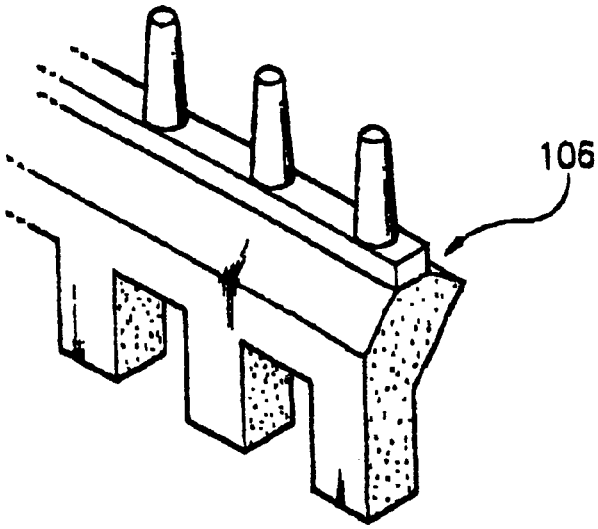

SAFETY INCINERATOR FOR RUBBISH IN VOLUME AND FLAMMABLE WASTE

BACKGROUND OF THE INVENTION

1. Field of the Invention

This invention relates to a mass incinerator which can incinerate continuously various rubbish (life rubbish, industrial wastes, hospital rubbish and the like) and flammable wastes (hospital wastes, poison and the like) at high temperature, particularly, to an incinerator in which several combustion chambers constructed in a dome form such as a pottery kiln are connected in a tunnel shape to form the incinerator. Each combustion chamber is made of ceramic material to show the high thermo-keeping and the excellent emission function of the infrared ray. It has an air supply device and an auxiliary fuel feeding device to incinerate continuously rubbish or wastes for a long time. Thus, any pollutant is not discharged and the heat occurring during the combustion process makes hot water.

2. Description of the Prior Art

According to the development of the industry, the amount of rubbish and wastes has been increased day by day. The kinds thereof has been also varied so that the incinerator having the mass combustion function has been required. Various types of mass incinerators were developed in the past.

However, there are problems with the electricity and the petroleum as the combustion power of incinerators created high operational expenses.

SUMMARY OF THE INVENTION

This invention is designed to solve the problems as previously discussed. The object of the invention is to provide an incinerator for various rubbish and flammable wastes without depending on the electricity and the petroleum energy. Thus, the incinerators in the dome shape are made of ceramic material to be the tunnel type incinerator burning the wastes at high temperature.

BRIEF DESCRIPTIONS OF THE DRAWINGS

FIG. 1 is a perspective view showing the appearance of the invention.

FIG. 2 is a partial front view showing the inside of the invention.

FIG. 3 is a sectional view of the combustion chamber according to the invention.

FIG. 4 is an exemplary view of water cooled grate according to the invention.

FIG. 5 is an exemplary view of air cooled grate according to the invention.

DETAIL DESCRIPTION OF THE INVENTION

The present invention provides an incinerator 1 in a tunnel shape which is formed by connecting the combustion chamber 101 in a dome shape and the auxiliary combustion chamber 102 alternately, wherein the inside wall 1 na of the combustion chamber 101 is made of ceramic material mixed with natural minerals such as loess, plate-powder and mica, and the outside wall 1 ga thereof is made of heat insulating material so that the heat resistance and the thermo-keeping are high. The infrared rays are radiated therefrom and the high temperature atmosphere is kept. The air supply chamber is formed between the outside wall and the inside wall of the combustion chamber 101. The air supply chamber is connected to the supply pipe 201 and the outside air supply device 2. A large number of air vents 105 are formed along the inside wall 1 na to force the combustion air to the combustion chamber 101 from the air supply chamber 104. The air cooled grate 106 and the water cooled grate 107 are installed in two floors at the bottom of the combustion chamber. The air cooled grate 106 forms the air supply chamber 106*a* at the bottom thereof to be connected to the outside air supply device 2 and the air supply pipe 201 to force the outside air between the grates. The water cooled grate filled by water therein is connected to the feed water tank 107*a*, and then to the outside water supply device 10 and the communicating vessel 10*a*, 10*b* for circulating the cooled water. The hinged gate 3, 4 and 4*a* are installed at the outside and the inside of the input entrance 108 formed at the upper part of the combustion chamber 101. The combustibles are inputted through the double hinged gate so that the soot or the dust is not scattered outward when it is inputted. The auxiliary fuel feeding pipe 5 feeding the petroleum fuel is installed at the one side of the combustion chamber wall so that it can assist the combustion in case of need. The combustion auxiliary material 103 made of ceramic material is installed inside the auxiliary combustion chamber 102 near to the combustion chamber 101 to promote the complete combustion. The hot water producing device 601 is built at the one side of the outside wall of the combustion chamber to be connected to the hot water cylinder 6 so that the hot water can be produced by the heat radiated from the combustion chamber.

The mark 7 is a chimney, 1*a* is an entrance, 1*b* is a communicating vent and 1*e* is a gate.

The present invention as above has merits that the combustion chamber of the incinerator is made of heat insulating materials using ceramic material in a dome shape and the combustion chamber is connected to the auxiliary combustion chamber alternately and formed in a tunnel shape so that the combustion space is lengthened to burn combustibles under the high temperature atmosphere to complete combustion when the rubbish are burnt. The combustion auxiliary material 103 made of ceramic material is filled in the auxiliary combustion chamber 102 connected to the combustion chamber 101 to reburn the noncombustion gas to complete combustion so that environmental pollution is not. At the bottom of the combustion chamber, the air cooled grate 106 and the water cooled grate 107 are overlapped to support the burning of materials so that abundant combustion air can be supplied to burn a large quantity of combustibles vigorously and the combustion air is also supplied to the inside wall to assist the combustion so that the combustion for a long time is possible to accomplish the complete combustion. The inside wall is constituted of the heat resistant wall of the ceramic material so that the infrared ray is radiated when it is heated for a long time to promote the combustion. The temperature of the combustion chamber is kept over 1000° C. to burn completely the soot and the pollutants as well as pathogenic harmful material, so that it is safe. The double hinged gate 3, 4 and 4*a* are utilized during the input of rubbish or wastes to generate dusts outward so that the rubbish or the wastes can be inputted sanitarily and a bad smell outward does not occur. The hot water or the vapor can be produced by the heat radiated from the combustion process to generate the electricity as well as to use the hot water. Therefore, the incinerator can be used widely.

What is claimed is:

1. An incinerator for mass rubbish and wastes, comprising:

a tunnel shaped incinerator formed by connecting in an alternating fashion a large number of combustion chambers and auxiliary combustion chambers in a dome shape wherein an inside wall of the combustion chamber is made of heat resistant ceramic material mixed with natural minerals selected from the group consisting of loess, plate-powder and mica, and an outside wall thereof is made of heat insulating material;

an air supply chamber formed between the outside wall and the inside wall of the combustion chamber, wherein the air supply chamber is connected to a supply pipe and an outside air supply device;

a large number of air vents formed along the inside wall;

an air cooled grate and a water cooled grate overlapping at a bottom of the combustion chamber, the air cooled grate connected to a feed water tank for feeding water therein to circulate with an outside water feeding device;

auxiliary combustion material for filling in the auxiliary combustion chamber; a plurality of hinged gates installed at an outside and an inside of an input entrance of the combustion chamber to form double hinged gates; and an auxiliary fuel feeding pipe installed in the combustion chamber.

* * * * *